US006609907B1

(12) United States Patent
Wood et al.

(10) Patent No.: US 6,609,907 B1
(45) Date of Patent: Aug. 26, 2003

(54) APPARATUS AND METHOD TO CONTROL EMISSIONS OF NITROGEN OXIDE

(75) Inventors: Stephen C. Wood, Houston, TX (US); Ravindra K. Agrawal, Houston, TX (US)

(73) Assignee: Entropy Technology and Environmental Consultants, LP, Houston, TX (US)

( * ) Notice: Subject to any disclaimer, the term of this patent is extended or adjusted under 35 U.S.C. 154(b) by 0 days.

(21) Appl. No.: 10/041,191

(22) Filed: Jan. 8, 2002

Related U.S. Application Data

(60) Provisional application No. 60/268,051, filed on Feb. 13, 2001, and provisional application No. 60/272,361, filed on Mar. 2, 2001.

(51) Int. Cl.[7] ..... F27D 7/04

(52) U.S. Cl. ..... 432/152; 432/176; 432/199; 110/204; 110/206

(58) Field of Search ..... 432/57, 152, 176, 432/199; 110/203, 204, 206, 345

(56) References Cited

U.S. PATENT DOCUMENTS 3,645,516 A * 2/1972 Turpin et al. ..... 432/17
4,242,972 A * 1/1981 Sicard ..... 110/206
4,926,765 A * 5/1990 Dreizler et al. ..... 110/234
5,259,342 A 11/1993 Brady et al.
5,868,562 A * 2/1999 Watanabe et al. ..... 432/176
6,247,917 B1 6/2001 Berger et al.
6,431,859 B1 * 8/2002 Neville et al. ..... 432/176

OTHER PUBLICATIONS

Agrawal & Wood, Cost–effective NOx Reduction, *Chemical Engineering*, Feb. 2001.

* cited by examiner

*Primary Examiner*—Gregory Wilson
(74) *Attorney, Agent, or Firm*—Kenneth H. Johnson

(57) ABSTRACT

A combustion apparatus and process for improved flue gas recirculation wherein the recirculation line penetrates into an exhaust duct, such as the exhaust stack for capturing and directing a portion of said flue gas through the recirculation line which is connected to an air fan inlet which provides induction of the flue gas into the combustion unit. The portion of the recirculation line that extends into the exhaust stack is preferably aerodynamically configured to capture a portion of a flue gas stream without detrimental impedance of the gas flow.

9 Claims, 2 Drawing Sheets

APPARATUS AND METHOD TO CONTROL EMISSIONS OF NITROGEN OXIDE

This application claims the benefit of Provisional application Ser. No. 60/268,051, filed Feb. 13, 2001, and No. 60/272,361, filed Mar. 2, 2001.

BACKGROUND OF THE INVENTION

1. Field of the Invention

The present invention relates to an apparatus and method for improving flue gas recirculation to minimize the oxides of nitrogen in exhaust emissions.

2. Related Information

Nitrogen oxides ("NOx") are among the primary air pollutants emitted from combustion processes. NOx emissions have been identified to contribute to ground-level ozone formation, visibility degradation, acid rain and human health concerns. As a result environmental regulations have been the main driver forcing industry to install systems to control NOx emissions.

There are two primary sources for NOx generated during combustion: Fuel NOx and Thermal NOx. NOx formed due to conversion of chemically bound nitrogen is referred to as Fuel NOx. Thermal NOx refers to NOx formed from high temperature oxidation (or "fixation") of atmospheric nitrogen. NO is the major constituent of thermal NOx and its formation can be modeled by the Zeldovich equation:

$$[NO]=k_1\cdot\exp(-k_2/T)\cdot[N_2]\cdot[O_2]^{1/2}\cdot t$$

where, [ ]=mole fraction, k's=constants, T=temperature, and t=residence time. *The Oxidation of Nitrogen in Combustion and Explosion,* J. Zeldovich, Acta Physiochim, U.S.S.R. (Moscow), 21 (4), pp577–628 (1946). The equation indicates that NOx formation is an exponential function of temperature and a square root function of oxygen concentration. Thus, by manipulating the temperature or oxygen concentration the formation of thermal NOx can be controlled. The main control strategies for reducing thermal NOx emissions can be characterized into two types: (i) Stoichiometry-based combustion modification systems designed to control the mixing of fuel and air to modify the concentration of oxygen in the flame zone, and (ii) Dilution-based combustion modification systems designed to reduce flame temperature in the flame zone. Post Combustion control of flue gas to remove NOx such as Selective Catalytic Reduction (SCR) and Non-Selective Catalytic Reduction (NSCR) are not only expensive but also operate on a different principle from the present invention.

Stoichiometry-based Combustion Control techniques involve altering the oxygen concentration in the flame zone to lower NOx formation. Examples for stoichiometry-based combustion controls include: Low NOx Burners and Off-Stoichiometric Combustion (e.g., Over Fire Air, and Burners Out of Service). These technologies effectively control NOx emissions by providing air staging to create an initial, fuel-rich zone (partial combustion zone) followed by an air-rich zone to complete the combustion process. Some burner manufacturers also offer fuel staging, which results in ultra low levels of NOx, primarily because they are also designed to recirculate flue gas.

Dilution-based Combustion Control techniques such as Flue Gas Recirculation and Water/Steam Injection control technologies reduce thermal NOx formation by introducing inerts which absorb heat, thereby, reducing peak flame temperatures. Although dilution methods also reduce oxygen concentration in the flame zone, little reduction in NOx is expected from this mechanism. Water Injection reduces flame temperatures by absorbing the latent heat of vaporization, and as such, it results in decreasing the efficiency. Thus, it is mainly recommended as a temporary control measure to reduce NOx during peaking periods.

Flue Gas Recirculation ("FGR") technology, also referred to as Windbox-FGR, does not suffer from this handicap and has minimal impact on efficiency. In a typical Windbox-FGR application, about 10 to 25% of the flue gases are recycled back to the combustion zone resulting in NOx reduction of up to 80%. Recirculating flue gas back to the combustion zone has been one of the most effective methods of reducing NOx emissions from gas and oil fired boilers since the early 1970's. In conventional applications, the recirculated flue gas is typically extracted from the combustion unit's outlet duct, upstream of the air heater. The flue gas is then returned through a separate duct and hot gas fan to the combustion air duct that feeds the windbox. The recirculated flue gas is mixed with the combustion air via air foils or other mixing devices in the duct. Windbox-FGR systems require installation of a separate hot gas FGR fan to move flue gas from the boiler exit to the air supply ducting at the windbox inlet, where mixing of the air and flue gas must be uniformly achieved by installation of appropriate mixing devices.

Most of the cost associated with Windbox-FGR technology is due to an additional fan or hot gas fan requirement to transport the flue gas. Thus, there is a need in the art for a simple and inexpensive flue gas recirculation system.

The present invention also reduces the cost by eliminating the need for a hot gas fan to redirect the flue gas into the combustion zone. The present invention eliminates the need for a separate hot gas fan (or FGR fan) and windbox mixing devices. U.S. Pat. No. 6,247,917 is a passive FRC which does not require a hot gas fan and obtains a pressure drop in the recirculation line by adjusting the size of the air intake line. The present invention does not require an air intake line, but is fully operably if one is present, without any sizing nor does the present invention utilize a hot gas fan.

SUMMARY OF THE INVENTION

Briefly the present invention is an apparatus and process for improved flue gas recirculation wherein the apparatus comprises: a combustion unit, an exhaust duct for removing flue gas from the combustion unit, an air fan having an inlet for delivering combustion air through said inlet into said combustion unit for combustion of a fuel therein, and a recirculation line penetrating into the exhaust duct and having an inlet therein for capturing and directing a portion of said flue gas, said recirculation line being connected to said air fan inlet to provide induction of flue gas by said air fan into said combustion unit. The portion of the recirculation line that extends into the exhaust duct is preferably aerodynamically configured to capture a portion of a flue gas stream without detrimental impedance of the gas flow. Various configurations may be used such as a closed tubular member having an opening facing toward the flue gas flow, which serves to capture a portion of the gas and facilitate its recycle by using some of the dynamic energy in the gas flow.

The recirculation line may be connected directly to cover a portion of the inlet of the air intake fan or into an air line attached to said inlet. The term "combustion unit" includes fired heaters, boilers, ethylene furnaces, incinerators, steam generators, process heaters and the like. The term "duct" as used herein includes ducts, lines, flues, stacks and any equivalent elements.

DETAILED DESCRIPTIONS

Figure 1:
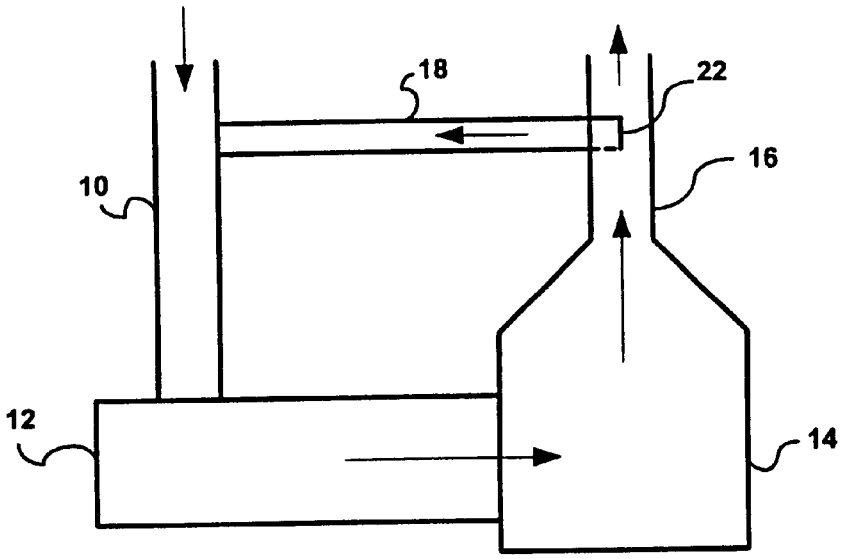
FIG. 1 is schematic elevational representation of one embodiment of the apparatus of the present invention having the recirculation line connected to an air intake line.

The innovation of the Induced-FGR lies in the fact that it extracts the flue from an exhaust duct or stack, which is at a pressure typically less than 0.1 inches of water, and redirects the flow to the forced draft fan. The extraction is achieved by the penetration of the Induced-FGR duct into the flue gas duct, transporting the flue from the combustion zone to the stack, to capture and redirect the flue gas to the forced draft fan. The recirculation duct penetrates into the exhaust duct to capture and redirect the flue gas. The penetration of the exhaust duct to capture the flow and redirect the flue is key to the success of the invention.

The invention utilizes the forced draft fan also referred to as a combustion air fan to pull (induce) flue gas from the combustion exhaust duct into the combustion air at the fan inlet. The fan also serves as the mixing device. Since the fan suction is used to induce the flue into the combustion zone, the invention technology is referred to hereinafter as Induced Flue Gas Recirculation ("Induced-FGR"). The Induced-FGR System for a typical combustion application includes ducting between an exhaust duct or flue and the Forced Draft Fan ("FDF") inlet ducts, and the necessary flow control dampers to achieve the desired degree of flue gas recirculation over the operating load range of the combustion unit. The recirculation line penetrates into an exhaust duct into a gas flow stream, for example the recirculation line passes through a wall of the exhaust stack and into the interior of the stack. Preferably an opening is located in the recirculation line interior of the exhaust duct and facing the gas flow. The recirculation line is sized to achieve the requisite recirculation of flue gas to reduce the NOx and to minimize the obstruction of the flue gas out of the stack. Preferably the cross sectional area of the recirculation line and the opening therein are less than one-third of the cross sectional area of the exhaust duct.

Another aspect of the present invention is the Induced-FGR transition to the forced draft fan. The Induced-FGR transition duct covers a portion of the fan intake to create an "induction" of the flue gas into the fan. The fan then acts as a mixing device to mix the hot flue gas with combustion air. The method to capture and redirect the flue and transport the flue by the induction or suction created by the FDF or combustion air fan is another important aspect of the invention.

Based on test data, the invention was found to reduce NOx emissions by up to 80% and improves the combustion efficiency and performance.

Another feature of the invention is that it operates on a different principle for NOx reduction when compared to Low NOx Burners, and other Off Stoichiometric combustion processes such as Over Fire Air and Burners out of Service. As such, it can be simultaneously used with them to obtain even higher reductions of NOx.

In the drawings, the same components in different views or embodiments use the same numbers. The drawings are not intended to limit the invention, but are merely illustrations.

Figure 3:
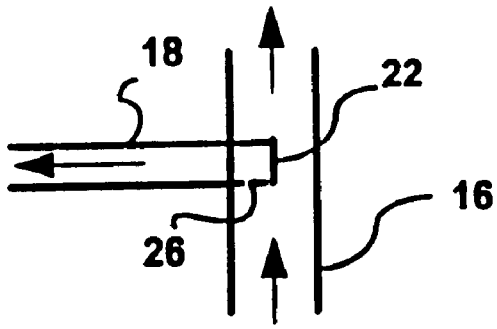
FIG. 3 is detail schematic representation of the exhaust stack embodiment of the apparatus of the present invention having the recirculation line penetrating laterally into the stack.

The arrows indicate the direction of gas flow within the system. Referring to FIG. 1 the recirculation line 18 extends into the exhaust stack 16 as the element 22 and is connected to inlet line 10 hence to the air inlet (not shown) of the fan 12, which is attached to a burner (not shown) to supply air for combustion of a fuel in a burner (not shown). The preferred fuels are gaseous and light liquid hydrocarbons. Unlike the passive flow systems that depend on sizing the air intake line to obtain the circulation in the system and require large recirculation lines, the present recirculation is dependent on the internal pressure of the flue gas flow which is captured through opening 26 (FIG. 3) by the lateral penetration 22 of line 18, and the air suction of the fan 12. Thus, once the requisite recirculation flow is determined for a particular combustion unit, the fan is adjusted to operate at a flow to maintain the recirculation.

Figure 2:
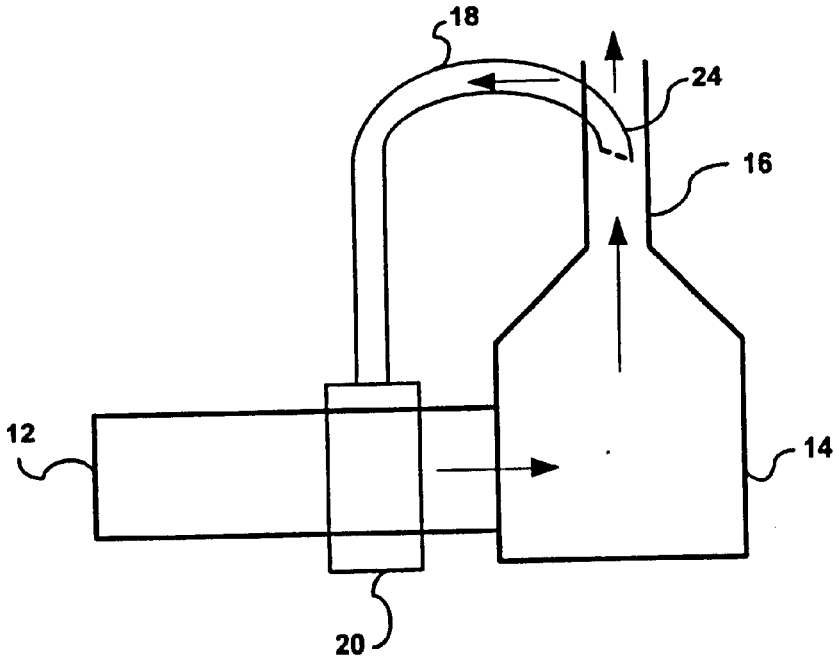
FIG. 2 is schematic elevational representation of an alternative embodiment the apparatus of the present invention having the recirculation line connected to a shroud of the fan intake.
Figure 4:
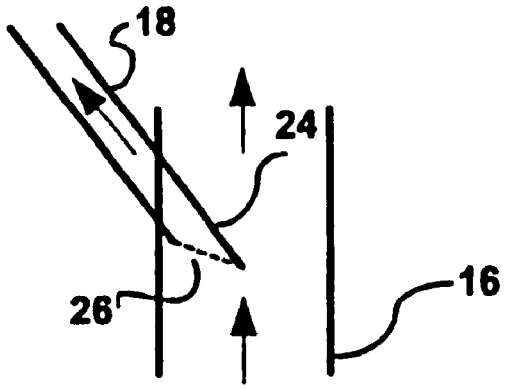
FIG. 4 is detail schematic representation of the exhaust stack embodiment of the apparatus of the present invention having the recirculation line penetrating diagonally into the stack.

In FIG. 2 the penetration 24 is diagonal to the stack 16 and to the flue gas flow with the opening 26 facing down stream. The diagonal penetration (FIG. 4) will reduce the pressure drop in the line 18, which in this embodiment is attached to a shroud or transition duct 20 which is placed over a portion of the air intake of fan 12.

The invention claimed is:

1. An apparatus comprising: a combustion unit wherein Thermal NOx is formed in use, an exhaust duct for removing flue gas from the combustion unit, an air fan having an inlet for delivering combustion air through said inlet into said combustion unit for combustion of a fuel therein, and a recirculation line penetrating said exhaust duct, said recirculation line, which penetrates and extends into said exhaust duct and having an inlet therein for capturing and directing a portion of said flue gas, the portion of the recirculation line extending into the exhaust duct being aerodynamically configured to capture said portion of a flue gas stream without detrimental impedance of said gas flow, said recirculation line connecting to said air fan inlet to provide induction of flue gas through said recirculation line by said air fan into said combustion unit to minimize pressure drop requirements for achieving high levels of flue gas recirculation for NOx control.

2. The apparatus according to claim 1 wherein the recirculation line is connected to a transition duct covering a portion of said fan inlet, to efficiently utilize the fan suction for achieving high levels of fuel gas recirculation for NOx control.

3. The apparatus according to claim 2 wherein said recirculation line penetrates and extends into said exhaust duct laterally.

4. The apparatus according to claim 2 wherein said recirculation line penetrates and extends into said exhaust duct diagonally.

5. The apparatus according to claim 1 wherein said recirculation line penetrates and extends into said exhaust duct laterally.

6. The apparatus according to claim 1 wherein said recirculation line penetrates and extends into said exhaust duct diagonally.

7. The apparatus according to claim 1 wherein said recirculation line penetrates and extends into said exhaust duct laterally.

8. The apparatus according to claim 1 wherein said recirculation line penetrates and extends into said exhaust duct diagonally.

9. The apparatus according to claim 1 wherein said exhaust duct comprises an exhaust stack.

* * * * *